US007905480B2

(12) United States Patent
Ito et al.

(10) Patent No.: US 7,905,480 B2
(45) Date of Patent: Mar. 15, 2011

(54) JOB SEPARATOR AND IMAGE RECORDING APPARATUS HAVING THE SAME

(75) Inventors: Shingo Ito, Kasugai (JP); Noritsugu Ito, Tokoname (JP); Wataru Sugiyama, Aichi-ken (JP); Naokazu Tanahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 12/024,012

(22) Filed: Jan. 31, 2008

(65) Prior Publication Data

US 2008/0179815 A1 Jul. 31, 2008

(30) Foreign Application Priority Data

Jan. 31, 2007 (JP) ..... 2007-021981

(51) Int. Cl.
*B65H 29/34* (2006.01)
*B65H 31/00* (2006.01)

(52) U.S. Cl. ..... 271/189; 271/188; 271/306; 271/207

(58) Field of Classification Search ..... 271/207, 271/189, 188, 306, 272–274, 296, 302; 399/405; 347/104; 400/625

See application file for complete search history.

(56) References Cited

U.S. PATENT DOCUMENTS

| | | | | |
|---|---|---|---|---|
| 4,890,826 | A * | 1/1990 | Rutishauser | 271/296 |
| 5,315,361 | A * | 5/1994 | Sawada et al. | 399/403 |
| 6,250,754 | B1 * | 6/2001 | Bortolotti | 347/104 |
| 6,669,191 | B2 | 12/2003 | Lee | |
| 7,267,501 | B2 * | 9/2007 | Yang | 400/625 |

FOREIGN PATENT DOCUMENTS

| | | | |
|---|---|---|---|
| JP | 5221575 | A | 8/1993 |
| JP | 11334979 | A | 12/1999 |
| JP | 2003103855 | B2 | 4/2003 |

* cited by examiner

*Primary Examiner* — Stefanos Karmis
*Assistant Examiner* — Luis Gonzalez
(74) *Attorney, Agent, or Firm* — Baker Botts L.L.P.

(57) ABSTRACT

A job separator has a first roller unit and a second roller unit adjacent to the first roller unit. The first roller unit has a first driven roller and a first drive roller, which receive and convey a sheet between them. The second roller unit has a second driven roller and a second drive roller, which also receive and convey a sheet between them. The second drive roller may selectively move between a first position, in which the second drive roller is below the second driven roller, and a second position in which the second drive roller is above the second driven roller. An image processing apparatus has the job separator, a recording unit, an output tray, and a control unit for controlling the second drive roller.

11 Claims, 7 Drawing Sheets

JOB SEPARATOR AND IMAGE RECORDING APPARATUS HAVING THE SAME

CROSS REFERENCE TO RELATED APPLICATION

This application claims priority to and the benefit of Japanese Patent Application No. 2007-021981, filed Jan. 31, 2007, the entire disclosure of which is incorporated herein by reference.

BACKGROUND OF THE INVENTION

1. Field of the Invention

The invention relates to a job separator which may be configured to convey printed sheets by changing two conveyance positions back and forth, with respect to a sheet conveyance direction, onto an output tray of an image recording apparatus, and also relates to the image recording apparatus including the job separator.

2. Description of Related Art

Known image recording apparatuses such as printers, copiers, and facsimiles, include a device for ejecting printed sheets to a front or rear position with respect to a sheet conveyance direction, alternating between front and rear positions according to each document created on a computer or a word processor. In a known image recording apparatus, a plurality of pairs of drive rollers are positioned a predetermined distance away from one another, near a sheet ejection portion and in an upstream side with respect to a sheet conveyance direction. One pair of conveyance rollers, which is positioned nearest the sheet ejection portion, includes a drive roller positioned such that an upper surface of a sheet faces the drive roller, and an auxiliary roller positioned such that a lower surface of the sheet faces the auxiliary roller. The auxiliary roller is moved closer to or further away from the drive roller by a piston positioned on the side of the auxiliary roller, and the piston advances and retreats, thereby moving the auxiliary roller closer to or further away from the sheet to be fed.

In a known image recording apparatus, when the auxiliary roller faces the drive roller, the sheet is ejected onto an output tray, such that the leading end of the sheet is positioned downstream from a position between the rollers, with respect to the sheet conveyance direction. When the auxiliary roller moves away from the drive roller, such that the auxiliary roller stops at a position that is withdrawn from the upstream side in the sheet conveyance direction, the auxiliary roller does not contact or guide the lower surface of the sheet to be ejected. In this position, the sheet drops down when the sheet reaches an upstream side of the output tray, with respect to the sheet conveyance direction. In this manner, a known image recording apparatus can, for each document requested, change a position of a sheet to be ejected onto the output tray between an upstream-side position and a downstream-side position, alternately, with respect to the sheet conveyance direction.

Nevertheless, in a known image recording apparatus, the movable auxiliary roller moves back and forth in the sheet conveyance direction, on the side facing the lower surface of the sheet to be ejected. In addition, the piston configured to move the auxiliary roller is positioned also on the side facing the lower surface of the sheet to be ejected. In order to maintain the number of sheets accommodated by the output tray, space is provided in the output tray to allow the auxiliary roller to freely move. As a result, the height of the image recording apparatus increases, which increases the overall size of the image recording apparatus and may prevent the production of compact image recording apparatuses.

SUMMARY OF THE INVENTION

In an embodiment of the invention, a job separator comprises a first roller unit, comprising a first driven roller and a first drive roller, wherein the first driven roller and the first drive roller are configured to receive a sheet therebetween, and a second roller unit, positioned adjacent to and downstream of the first roller unit in a sheet conveyance direction. The second roller unit comprises a second driven roller and a second drive roller, wherein the second driven roller and the second drive roller are configured to receive a sheet therebetween. The second drive roller is configured to selectively move between a first position in which the second drive roller is positioned below the second driven roller, and a second position in which the second drive roller is positioned above the second driven roller. The first roller unit and the second roller unit are configured to convey a sheet in a substantially lateral direction.

According to another embodiment of the invention, an image recording apparatus comprises a recording unit configured to record an image on a sheet, a job separator positioned downstream of the recording unit in a sheet conveyance direction, the job separator comprising a first roller unit, comprising a first driven roller and a first drive roller, wherein the first driven roller and the first drive roller are configured to receive the sheet having the image thereon therebetween, and a second roller unit, positioned adjacent to and downstream of the first roller unit in the sheet conveyance direction. The second roller unit comprises a second driven roller, and a second drive roller, wherein the second driven roller and the second drive roller are configured to receive the sheet therebetween. The first roller unit and the second roller unit are configured to convey the sheet in a substantially lateral direction. The image forming apparatus further comprises an output tray positioned downstream of the job separator in the sheet conveyance direction, and a control unit configured to control a position of the sheet to be ejected on the output tray, wherein the control unit is configured to selectively move the second drive roller between a first position, in which the second drive roller is positioned below the second driven roller, and a second position, in which the second drive roller is positioned above the second driven roller.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF PREFERRED EMBODIMENTS

Embodiments of the present invention and their features and technical advantages may be understood by referring to FIGS. 1-7, like numerals being used for like corresponding portions in the various drawings.

As shown in FIG. 1, in an embodiment of the invention, an image recording apparatus, e.g., a printer 1, may be connectable with other machines, e.g., computers and facsimiles, and to telephone communication networks. Printer 1 may be configured to receive image data, e.g., photo data and text data, from connected machines and removable storage media, and may be configured to record images, e.g., photos and text, on a recording sheet P, based on the received image data.

Figure 1A:
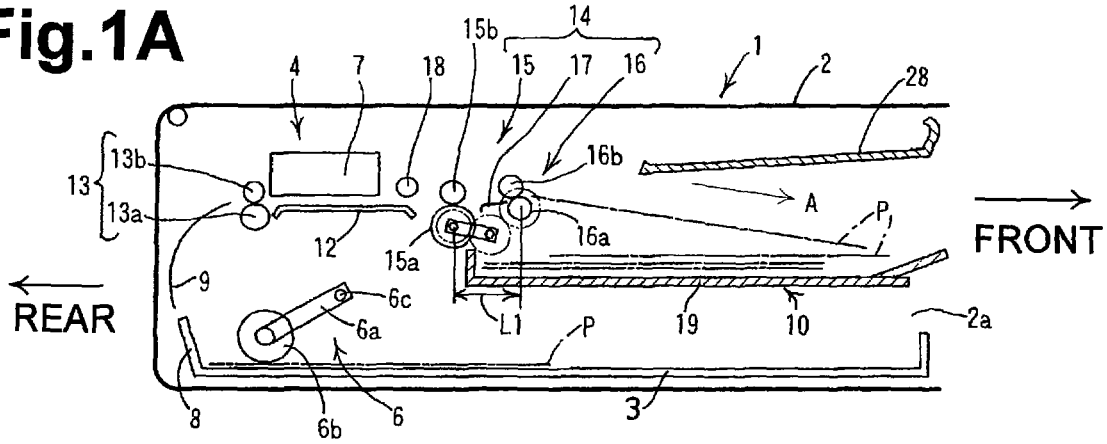
FIG. 1A is a schematic cross-sectional view of an image recording apparatus in which a printed sheet is conveyed toward an output tray on a downstream side of the image recording apparatus with respect to a sheet conveyance direction, according to an embodiment of the invention.
Figure 1B:
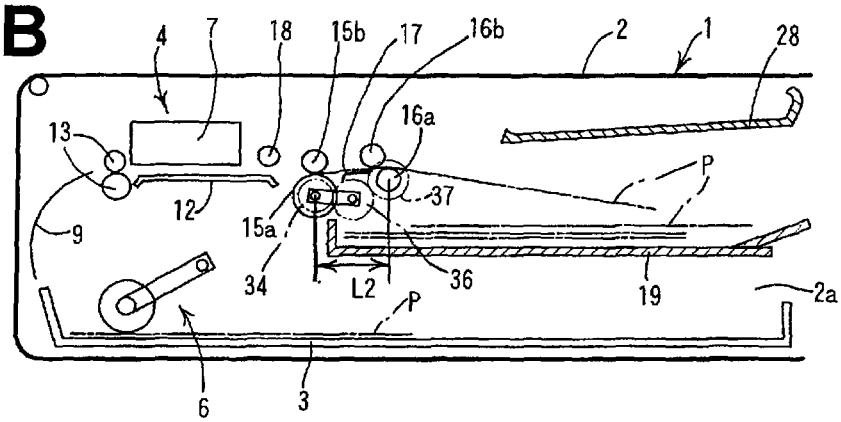
FIG. 1B is a schematic cross-sectional view of an image recording apparatus in which a printed sheet is fed on a rotating second drive roller, and the sheet is conveyed and ejected to an output tray on a downstream side of the image recording apparatus with respect to a sheet conveyance direction, according to an embodiment of the invention.
Figure 1C:
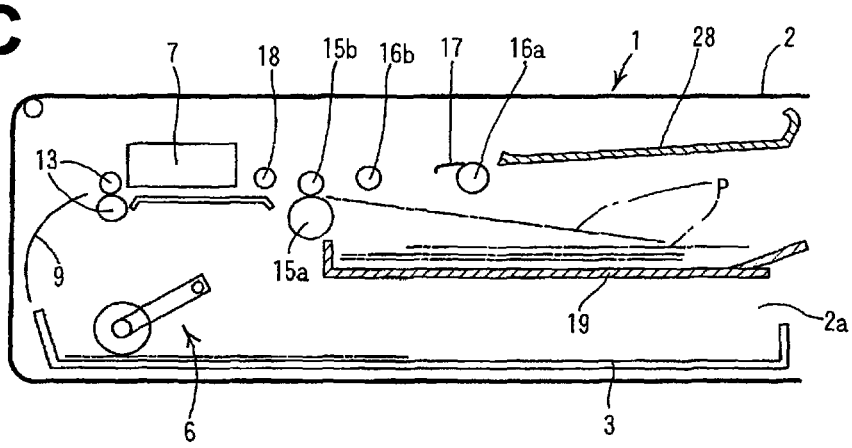
FIG. 1C is a schematic cross-sectional view of an image recording apparatus in which a second drive roller and a guide plate are withdrawn to a position higher than the second driven roller, and a printed sheet is ejected to the output tray on an upstream side with respect to a sheet conveyance direction, according to an embodiment of the invention.

As shown in FIGS. 1A to 1C, printer 1 may include a recording part 4, which may be housed in a main casing 2. Main casing 2 may be made of a synthetic resin, and may have a slot (not shown) configured to removably receive a removable storage medium. When the storage medium, which may include image data or other data, is inserted into the slot of main casing 2, printer 1 may display a list of images stored on the storage medium on a display part (not shown). A user may select a desired image from the listed images, and then may press a button, e.g., a digital camera print button, which may cause the desired image to be recorded or printed on sheet P. In this case, the image data may be directly sent from the storage medium to printer 1, bypassing a computer connected to printer 1, and may be recorded at a recording part 4.

A sheet supply tray 3 may be positioned in a bottom of main casing 2. Sheet supply tray 3 may be configured to be removably attached to an opening 2*a*, which may be provided at the front of main casing 2. Opening 2*a* may be generally aligned in a substantially horizontal alignment. Recording part 4 and an output tray portion 10 may be positioned above sheet supply tray 3. An inclined separation plate 8 for separating sheets may be positioned at the rear side of sheet supply tray 3. A sheet supply unit 6, which may be mounted to main casing 2, may include a sheet supply arm 6*a*, a sheet supply roller 6*b*, and a drive shaft 6*c*. Sheet supply arm 6*a* may be configured to pivot on drive shaft 6*c* vertically. Sheet supply roller 6*b* may be positioned at a lower end of sheet supply arm 6*a*, and may operate with an elastic separation pad, e.g., a leaf spring (not shown) of inclined separation plate 8, such that sheets P of a stack in sheet supply tray 3 may be singly separated and fed.

A sheet P separated from the stack may be fed via a U-shaped sheet feed path 9, to recording part 4, which may be positioned above sheet supply tray 3. Sheet P, which may be recorded at recording part 4, may be ejected to output tray portion 10 in a position such that a recorded surface of sheet P faces upward. A job separator 14 may be configured to convey sheets P to a front position or a rear position on output tray 19, alternately, with respect to sheet conveyance direction A.

Recording part 4 may include a carriage 7, which may be configured to move reciprocally, and to have a recording head, e.g., an inkjet-type recording head 48, positioned on a lower surface of carriage 7. Carriage 7 may be configured to slide, and may be supported by two guide members, one on the upstream side, and one on the downstream side of carriage 7, with respect to sheet conveyance direction A. Each guide member may extend in a y-axis direction, e.g., a main scanning direction, which may be perpendicular to a sheet conveyance direction with respect to FIGS. 1A to 1C.

Recording part 4 further may include a carriage (CR) motor 44, a platen 12, and an encoder strip (not shown). CR motor 44 may be configured to drive a timing belt stretched around pulleys which are positioned in parallel with the upper surface of the downstream-side guide member, in order to move carriage 7 reciprocally. Platen 12 may be a plate-like member and may be configured to support sheet P, which may be fed under recording head 48. The encoder strip may be positioned to extend in the main scanning direction. The encoder strip may be a part of an optical linear encoder, which may detect the position and the moving speed of carriage 7 in the main scanning direction.

Figure 3:
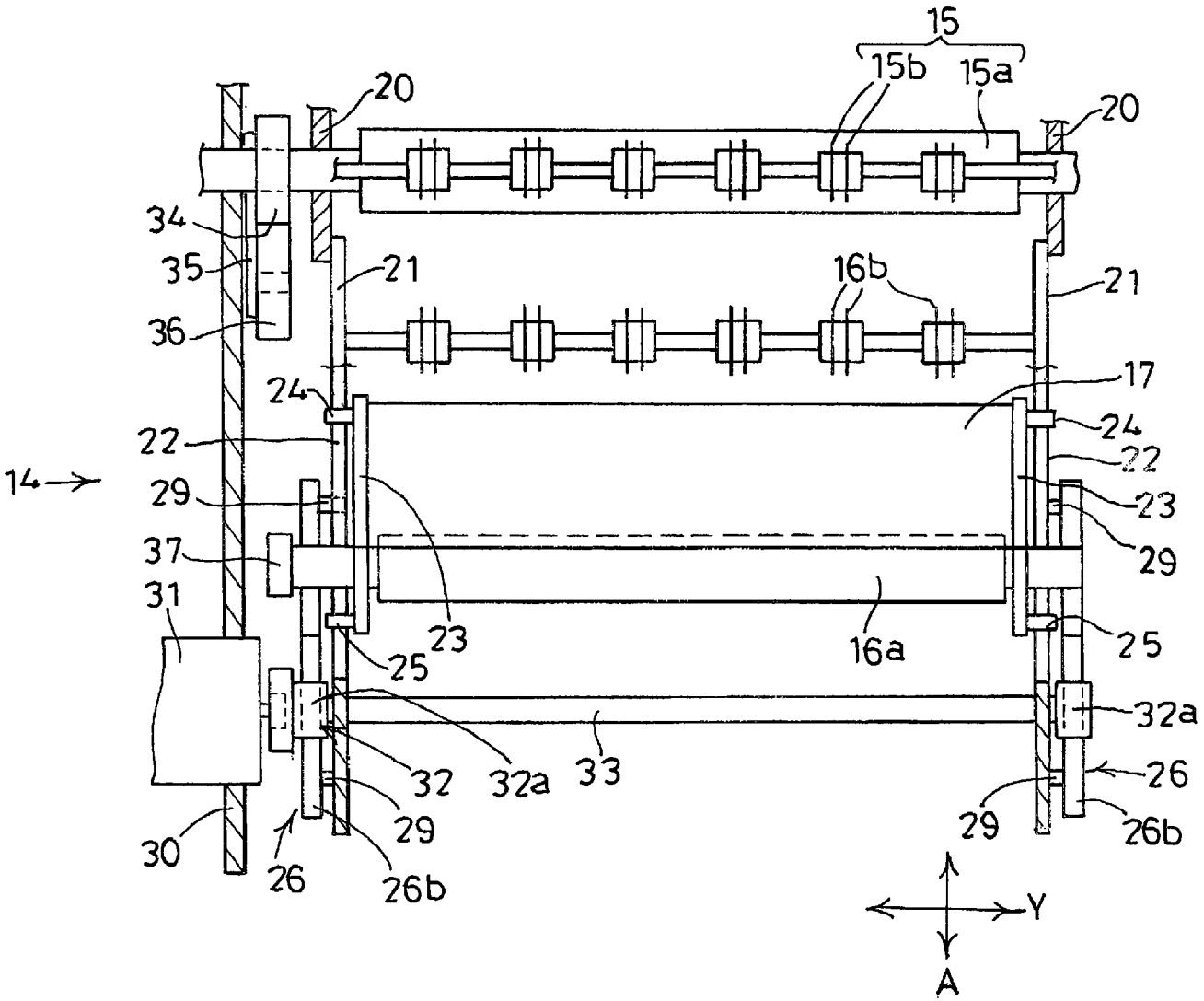
FIG. 3 is a schematic plan view of a job separator according to an embodiment of the invention.

As shown in FIGS. 1A and 3, a registration roller pair 13 may be positioned in an upstream direction from platen 12 in a sheet conveyance direction A. Registration roller pair 13 may combine a feeding function and a registration function. Registration roller pair 13 may include a drive roller 13*a* and a driven roller 13*b*, which may feed sheet P into a space between a nozzle surface on the lower surface of carriage 7 and platen 12.

Referring again to FIG. 1A, job separator 14 may be positioned downstream from platen 12 in sheet conveyance direction A. Job separator 14 may include a first conveyance roller unit 15 and a second conveyance roller unit 16. First conveyance roller unit 15 may be positioned adjacent to a downstream end of platen 12. Second conveyance roller unit 16 may be positioned downstream from first conveyance roller unit 15. Output tray portion 10 may include an output tray 19, which may be removably attached to main casing 2 through opening 2*a*.

First conveyance roller unit 15 may include a first drive roller 15*a* positioned such that a lower surface of sheet P may face first drive roller 15*a*, and a first driven roller 15*b* may be positioned such that an upper surface of sheet P may face first driven roller 15*b*. Sheet P may be contacted between first drive roller 15*a* and first driven roller 15*b*.

Second conveyance roller unit 16 may include a second drive roller 16*a*, a second driven roller 16*b*, and a guide plate 17. Second drive roller 16*a* may be positioned such that the lower surface of sheet P faces second drive roller 16*a*. Second drive roller 16*a* also may be configured to move from a first position, substantially near first conveyance roller unit 15, to a second position, further away from first conveyance roller unit 15 in sheet conveyance direction A. Second driven roller 16*b* may be positioned such that the upper surface of sheet P faces second driven roller 16*b*. Guide plate 17 may extend toward first conveyance roller unit 15, and may be configured to guide sheet P at the lower surface side of sheet P, while moving along with second drive roller 16*a*.

Ink may be ejected downward from recording head 48, which may be positioned on the lower surface of carriage 7, onto an upper surface of sheet P, which may be supported on platen 12. This ejected ink may cause an image to be recorded on the upper surface of sheet P. The upper surface of sheet P may contain partially wet immediately after the image has been recorded. As shown in FIG. 3, a plurality of first driven rollers 15*b* and second driven rollers 16*b* may be arranged at regular intervals on respective shafts in a width direction, e.g., a direction perpendicular to the sheet conveyance direction A, of sheet P, to reduce an area of the upper surface of sheet P which may contact portions of printer 1. Each of first driven rollers 15*b* and second driven rollers 16*b* may be a spur roller, and may have teeth formed on an outside surface of each roller in a circumferential direction. Another spur roller 18 also may be positioned downstream from and above platen 12, with respect to sheet conveyance direction A.

A pair of side plates 20 may support both ends of shafts of first drive roller 15*a* and first driven rollers 15*b* of first conveyance roller unit 15, while allowing first drive roller 15*a* and first driven rollers 15*b* to rotate. A sheet feeding motor 45 and a transmission gear train may drive first drive roller 15*a*. A pair of side frames 21 may support both ends of shafts of second drive roller 16*a* and second driven rollers 16*b* of second conveyance roller unit 16, while allowing second drive roller 16*a* and second driven rollers 16*b* to rotate. Both ends of a shaft of second drive roller 16*a* may be slidably engaged in guide grooves 22 provided in side frames 21. Guide grooves 22 may be inclined in a diagonally upward direction, toward a downstream side, with respect to sheet conveyance direction A in a side view.

Figure 2B:
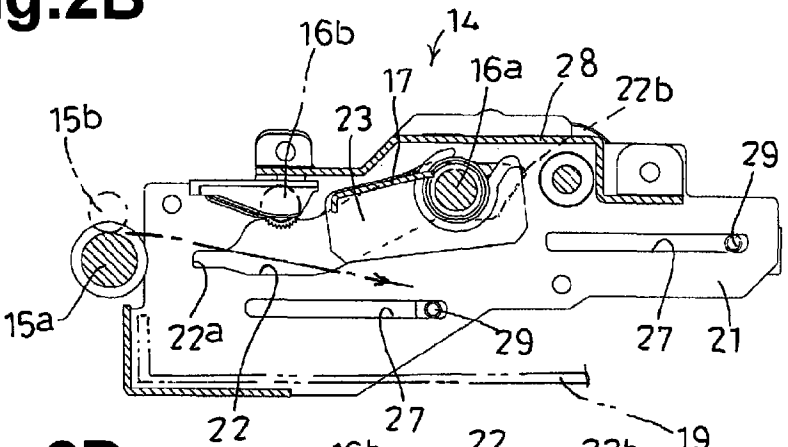
FIG. 2B is a cross-sectional view of a job separator when the image recording apparatus is in a state corresponding to the state shown in FIG. 1C.
Figure 2D:
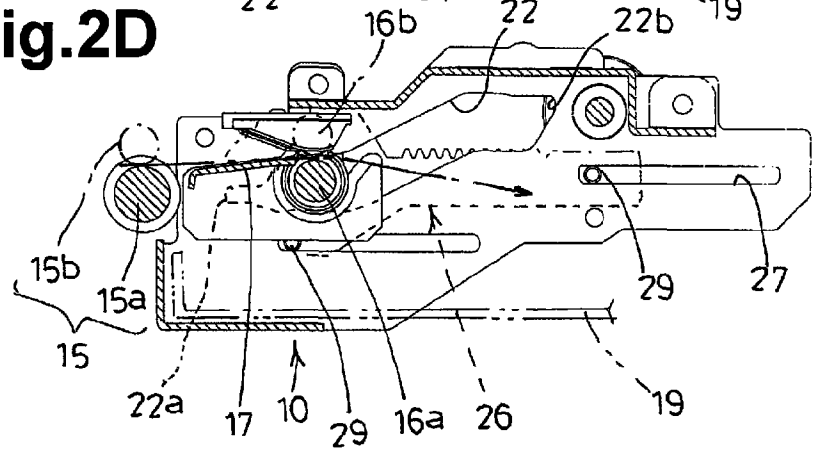
FIG. 2D is a cross-sectional view of a job separator when the image recording apparatus is in a state corresponding to the state shown in FIG. 1A.
Figure 2A:
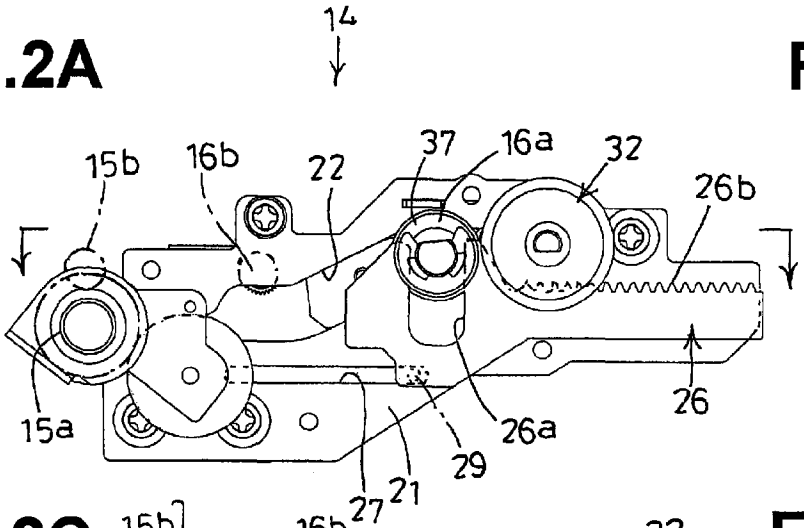
FIG. 2A is a left side view of a job separator when the image recording apparatus is in a state corresponding to the state shown in FIG. 1C.

As shown in FIGS. 2B and 2D, guide groove 22 may extend horizontally at a low position on a side close to second driven roller 16*b*, e.g., a beginning side, and may be inclined upward toward the downstream side with respect to sheet conveyance direction A, and may again extend horizontally at a high position on a side further away from second driven roller 16*b*, e.g., an ending side.

As shown in FIGS. 2B, 2D, and 5A to 5E, a first control guide groove 22*a* may be formed in communication with guide groove 22 at the beginning side. First control guide groove 22*a* may be configured to guide a first control pin 24 horizontally in sheet conveyance direction A, and may be configured to prevent first control pin 24 from moving vertically. Similarly, a second control guide groove 22*b* may be formed in communication with guide groove 22 at the ending side. Second control guide groove 22*b* may be configured to guide a second control pin 25 horizontally toward sheet conveyance direction A, and may be configured to prevent second control pin from moving vertically.

As shown in FIGS. 2B and 2D, guide plate 17 may be bent slightly downward at the side that is closer to first conveyance roller unit 15, e.g., the bending side. Both left and right sides of guide plate 17 may be attached to a pair of rotatable supporting plates 23, which may be engaged with both ends of a shaft of second drive roller 16*a*. Supporting plates 23 may be positioned in parallel with inner surfaces of side frames 21. The center of gravity of an assembly of supporting plates 23 and guide plate 17 may be located upstream from a center of the shaft of second drive roller 16*a*. First control pin 24 and second control pin 25 may protrude outward from corresponding supporting plates 23, and may be inserted into guide grooves 22. First control pin 24 may be positioned toward first control guide groove 22*a* from the end of a shaft of second drive roller 16*a*, and second control pin 25 may be positioned toward second control guide groove 22*b*, from the end of the shaft of second drive roller 16*a*.

When second drive roller 16*a* and guide plate 17 move together, either upstream or downstream with respect to sheet conveyance direction A, between left and right side frames 21, first control pin 24 and second control pin 25 may slide, and may be in contact with an upper end and lower end of each guide groove 22, first control guide 22*a*, and second guide control guide 22*b*. This contact may change and control a position of guide plate 17.

Figure 2C:
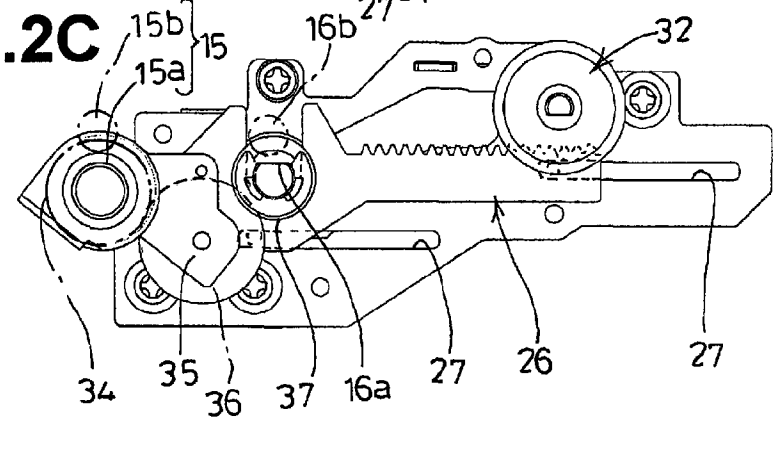
FIG. 2C is a left side view of a job separator corresponding when the image recording apparatus is in a state corresponding to the state shown in FIG. 1A.

A rack member 26 may be configured to move second drive roller 16*a* from a first position closer to first conveyance roller means 15, or to a second position, away from first conveyance roller means 15, along sheet conveyance direction A. Rack member 26 may include a U-shaped bearing 26*a* and a rack portion 26*b*. Bearing 26*a* may be formed on an upstream side of rack member 26 in sheet conveyance direction A, and may be designed to support each end of second drive roller 16*a*, such that second drive roller 16*a* may move vertically. Rack portion 26*b* may be formed on a downstream side of rack member 26 in sheet conveyance direction A and has teeth on its upper surface. Rack member 26 may be positioned parallel to an outer surface of each side frame 21. As shown in FIGS. 2B and 2C, guide pins 29 may protrude from rack member 26, and may be slidably engaged in a pair of guide portions 27 provided on upstream and downstream sides of each side frame 21. Guide portions 27 may be formed linearly in a horizontal direction, so that rack member 26 may be guided linearly in the horizontal direction, along side frame 21.

A rack drive motor 31 may be fixed to an outer frame 30. Rack drive motor 31 may be capable of rotating in both clockwise and counterclockwise directions. A gear transmission mechanism 32 may be positioned between one side frame 21 and outer frame 30. Gear transmission mechanism 32 may transmit a driving force from a pinion of rack drive motor 31 to rack portion 26*b* of rack member 26. Gear transmission mechanism 32 may include one or more driven gears 32*a*. Driven gears 32*a* may be fixed to both ends of a rotating shaft 33 and may be engaged with rack portions 26*b* of rack members 26, on outer surfaces of side frames 21.

Referring again to FIGS. 1A and 2C, a first gear 34 may be fixed to an end of first drive roller 15*a*, and an arm 35 may be rotatably supported by the end of first drive roller 15*a*. An intermediate gear 36 may be supported at an end of arm 35, and may be engaged with first gear 34. Arm 35 may be urged upward by a spring (not shown). When second drive roller 16*a* approaches first conveyance roller unit 15, intermediate gear 36 may engage a second gear 37 positioned at an end of the shaft of second drive roller 16*a*. When second drive roller 16*a* is separated from first conveyance roller unit 15 on the downstream side in sheet conveyance direction A, intermediate gear 36 may disengage from second gear 37.

When second conveyance roller unit 16 is located a distance L1 away from first conveyance roller unit 15, first drive roller 15*a* and second drive roller 16*a* may be positioned at roughly the same height, so that sheet P may be contacted between first drive roller 15*a* and first driven roller 15*b*, and also between second drive roller 16*a* and second driven roller 16*b*. Thus, sheet P, which may be positioned and contacted between second drive roller 16*a* and second driven roller 16*b*, is conveyed, ejected, and placed on a downstream side of output tray 19 in sheet conveyance direction A. As shown in FIG. 2C, in this state, power may be transmitted from first gear 34, positioned at the end of the shaft of first drive roller 15*a*, to second gear 37, via intermediate gear 36. First drive roller 15*a* and second drive roller 16*a* may rotate in the same direction, at the same circumferential velocity, e.g., a velocity of a point on the outer circumference of the roller.

Referring again to FIG. 1B, when second conveyance roller unit 15 is located distance L2, e.g., L1+ΔL, away from first conveyance roller unit 15, arm 35 may be urged upward by the spring, and may move upward. Intermediate gear 36 may maintain engagement with second gear 37 of second drive roller 16*a*. Second drive roller 16*a* may be separated from second driven rollers 16*b* such that second driven roller 16*b* and sheet P may not be in contact, although first drive roller 15*a* and second drive roller 16*a* may rotate in the same direction at the same circumferential velocity. Sheet P may be received by guide plate 17, and placed on second drive roller 16*a*, which may be in operation. Thus, sheet P may be ejected on the downstream side of output tray 19, in sheet conveyance direction A.

As shown in FIG. 1C, when second conveyance roller unit 16 withdraws from first conveyance roller unit 15 toward the downstream side in sheet conveyance direction A, second drive roller 16*a* and guide plate 17 may withdraw to a position higher than or equal to second driven roller 16*b*, and a rotational force may not reach second drive roller 16*a*. In other words, printed sheet P, which may move to the downstream side in sheet conveyance direction A, may directly be ejected to an upstream side of output tray 19 in sheet conveyance direction A without being received by guide plate 17.

Figure 4A:
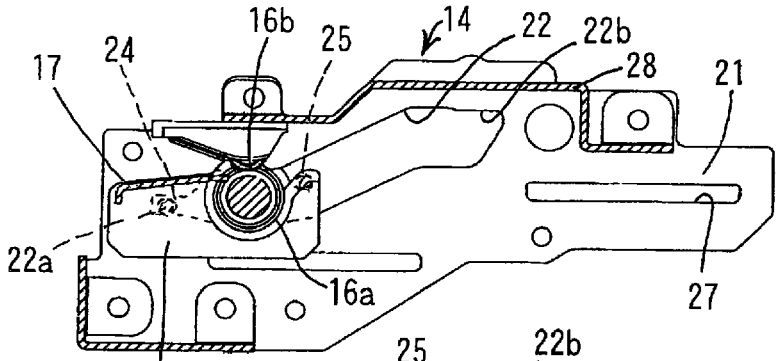
FIG. 4A is a view of the height and the position of a second drive roller and a guide plate when the second drive roller is in the most upstream position, with respect to a sheet conveyance direction, according to an embodiment of the invention.
Figure 4B:
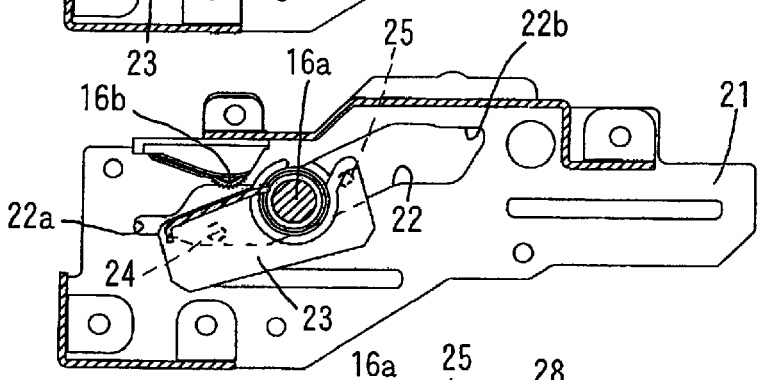
FIG. 4B is a view of the height and the position of a second drive roller and a guide plate when the second drive roller begins moving downstream, with respect to a sheet conveyance direction.
Figure 4C:
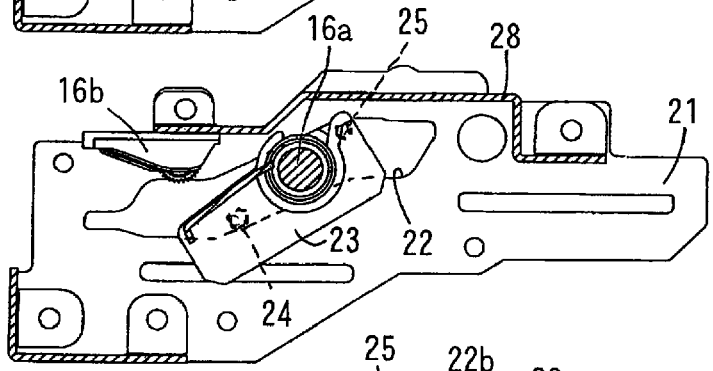
FIG. 4C is a view of the height and the position of a second drive roller and a guide plate when the second drive roller has moved further downstream than in FIG. 4B, with respect to a sheet conveyance direction.
Figure 4D:
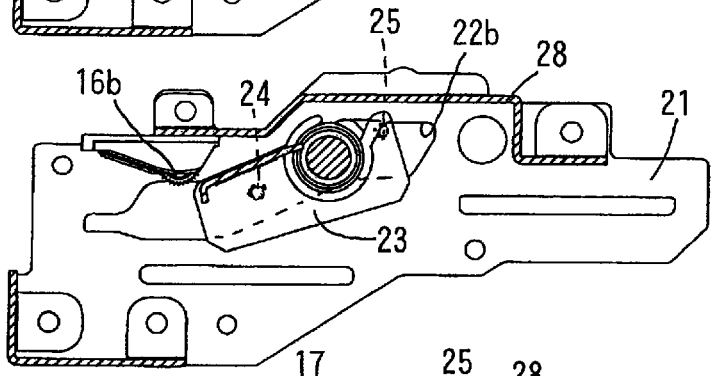
FIG. 4D is a view of the height and the position of a second drive roller and a guide plate when the second drive roller has moved still further downstream than in FIG. 4C, with respect to a sheet conveyance direction.
Figure 4E:
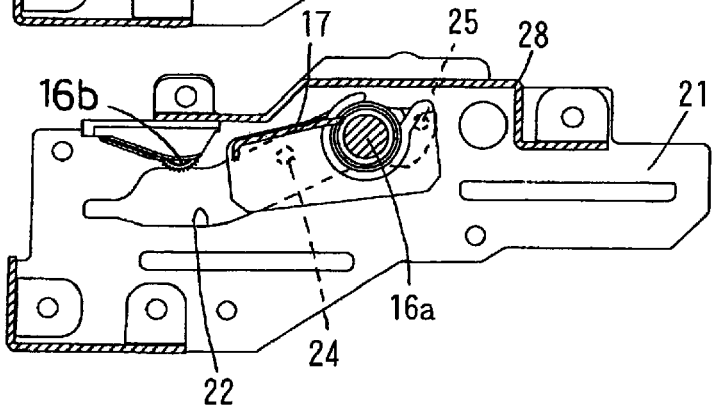
FIG. 4E is a view of the height and the position of a second drive roller and a guide plate when the second drive roller and second driven rollers contact a recorded sheet and the second drive roller is in the furthest downstream position, with respect to a sheet conveyance direction.

FIGS. 4A to 4E illustrate changes in height and position of second drive roller 16*a* and guide plate 17 when second drive roller 16*a* moves from the most upstream position, illustrated in FIG. 4A in sheet conveyance direction A, to a position in which second drive roller 16*a* and second driven rollers 16*b* may contact and urge a recorded sheet to the most downstream position, illustrated in FIG. 4E, in sheet conveyance direction A.

FIGS. 5A to 5E illustrate changes in positions of first control pin 24 and second control pin 25 in association with FIGS. 4A to 4E. In a state shown in FIGS. 4A and 5A, which also may be the state shown in FIG. 1A, second drive roller 16*a* may be positioned in the first position, e.g., furthest upstream side in sheet conveyance direction A, and second drive roller 16*a* and second driven roller 16*b* may be capable of conveying sheet P therebetween. At this time, first control pin 24 may be fitted in first control guide groove portion 22*a*, at the beginning side of guide groove 22, such that first control pin 24 may move in a substantially horizontal direction. Guide plate 17 may be placed at a height such that guide plate 17 may receive and support sheet P, which may have been conveyed between first drive roller 15*a* and first driven roller 15*b*, from below. The bending side of guide plate 17, which may face first conveyance roller unit 15, may be inclined slightly downward. Thus, sheet P may be ejected on the downstream side on the output tray 19 in sheet conveyance direction A.

Figure 5A:
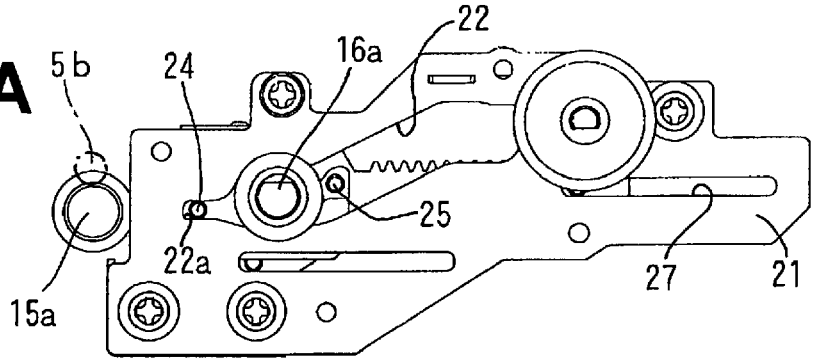
FIG. 5A is a view of the height and the position of a first and second control pin positioned within a guide groove when the second drive roller and the guide plate are in the position illustrated in FIG. 4A.
Figure 5B:
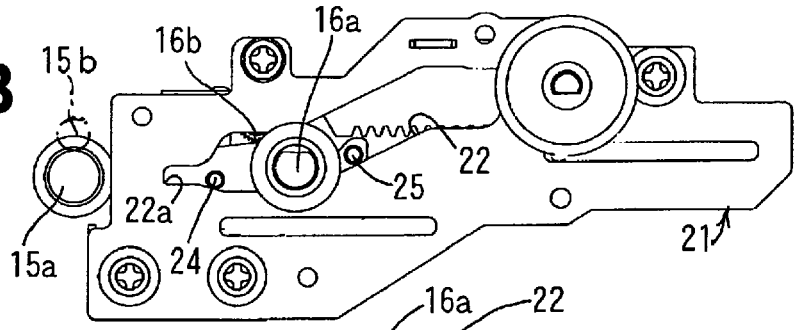
FIG. 5B is a view of the height and the position of a first and second control pin positioned within a guide groove when the second drive roller and the guide plate are in the position illustrated in FIG. 4B.
Figure 5C:
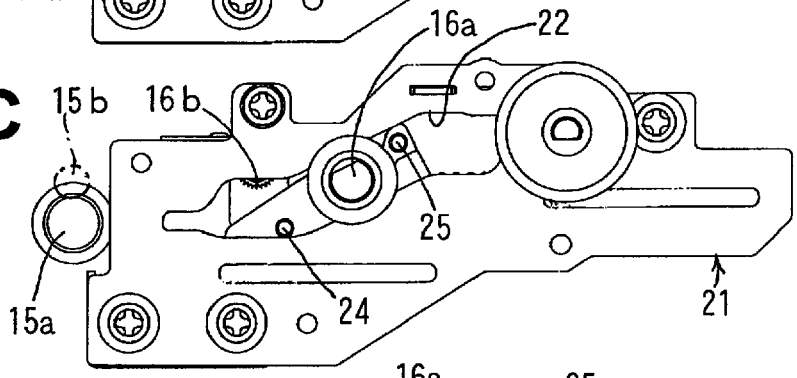
FIG. 5C is a view of the height and the position of a first and second control pin positioned within a guide groove when the second drive roller and the guide plate are in the position illustrated in FIG. 4C.

In a state shown in FIGS. 4B and 5B, second drive roller 16*a* may move slightly downstream from second driven roller 16*b*, and may release contact of sheet P. At this time, first control pin 24 may move out of first control guide groove portion 22*a*, and second control pin 25 may slide on a lower edge of guide groove 22, that may be inclined upward. Second drive roller 16*a* may move slightly upward and, guide plate 17 may be inclined downward at the bending side at a height such that guide plate 17 receives sheet P, which may have been conveyed between first drive roller 15*a* and first driven rollers 15*b* from below. The state shown in FIGS. 4B and 5B also may be the same state shown in FIG. 1B.

In the state shown in FIGS. 1A and 1B, second drive roller 16*a* and the lowermost portion of guide plate 17 may be positioned higher than the maximum height of stack of sheets P in output tray 19. In a state shown in FIGS. 4C and 5C, second drive roller 16*a* may move further downstream in sheet conveyance direction A, along the upward inclined portion of guide groove 22, and may be positioned higher compared to the state shown in FIGS. 4B and 5B. At this time, first control pin 24 may slide on the lower edge of the inclined portion of guide groove 22, second control pin 25 may slide on the upper edge of the inclined portion of guide groove 22, and guide plate 17 may be maintained with a maximal downward incline at the bending side.

Figure 5D:
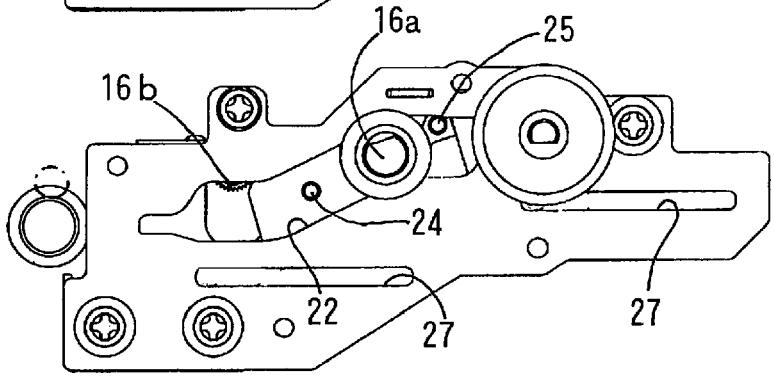
FIG. 5D is a view of the height and the position of a first and second control pin positioned within a guide groove when the second drive roller and the guide plate are in the position illustrated in FIG. 4D.

In a state shown in FIGS. 4D and 5D, second drive roller 16*a* may be guided to an upper portion of the upward inclined portion of guide groove 22, and may be positioned higher than all portions of second driven rollers 16*b*. At this time, second control pin 25 may move in guide groove 22 from an upper edge of the upward inclined portion to a horizontal portion. The bending side of guide plate 17 may be raised upward, while its inclination angle may be restricted, such that guide plate 17 may not interfere with second driven rollers 16*b*.

Figure 5E:
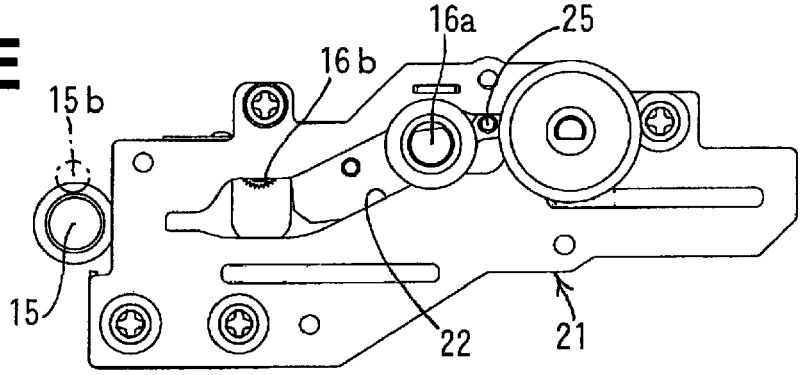
FIG. 5E is a view of the height and the position of a first and second control pin positioned within a guide groove when the second drive roller and the guide plate are in the position illustrated in FIG. 4E.

In a state shown in FIGS. 4E and 5E, which also may be the state shown in FIG. 1C, second drive roller 16*a* may be guided to the horizontal portion in the upper portion of guide groove 22, and second drive roller 16*a* may be positioned at the second position, e.g., the highest position and the furthest position away from second driven rollers 16*b*. At this time, second control pin 25 may slide in contact with an upper edge of second control guide portion 22*b*, and guide plate 17 may be positioned with the bending side raised upward. Guide plate 17 and second drive roller 16*a* may be withdrawn, such that their lowest positions may be higher than a height of a path of sheet P ejected by first conveyance roller unit 15.

Figure 6:
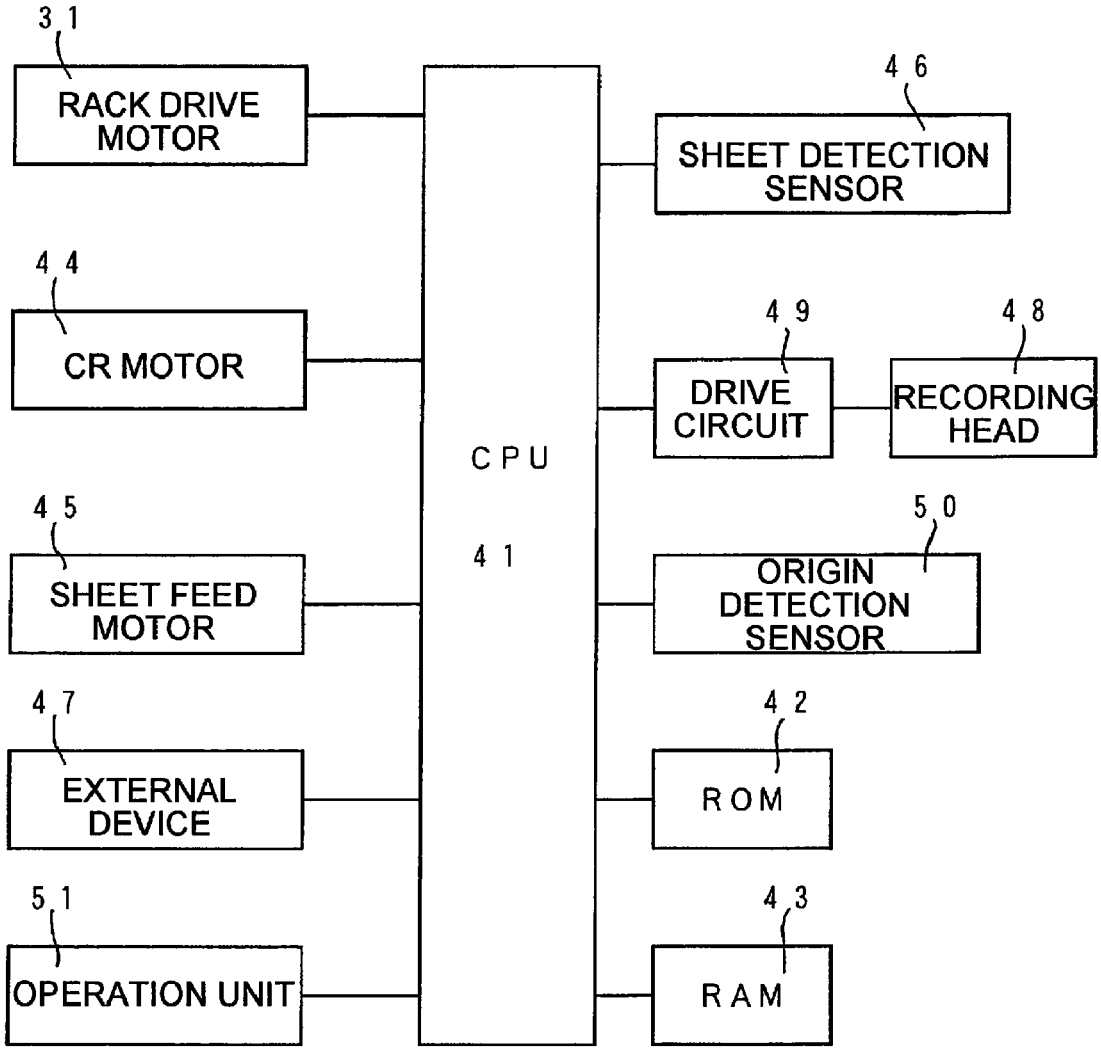
FIG. 6 is a control block diagram of an image processing apparatus according to an embodiment of the invention.

FIG. 6 illustrates a control block diagram of printer 1, including CPU 41, ROM 42, and RAM 43. CPU 41 may perform various operations, e.g., image recording operations, and movement control operations of second drive roller 16*a*. ROM 42 may store control programs and data required for operations, which may be retrieved and executed when CPU 41 performs each operation. A specified area of RAM 43 may be used as a work area and a buffer area for each operation.

In an embodiment of the invention, a user selects a document to be printed on sheet P. When a print operation starts, e.g., an image recording operation for the document is ordered, a conveyance position of sheet P on output tray 19 may be set to an upstream side or a downstream side, with respect to sheet conveyance direction A, by job separator 14. When a plurality of image recording operations for corresponding documents are ordered, a conveyance position of each document may be alternated between the upstream side and downstream side, with respect to sheet conveyance direction A, on output tray 19.

Figure 7:
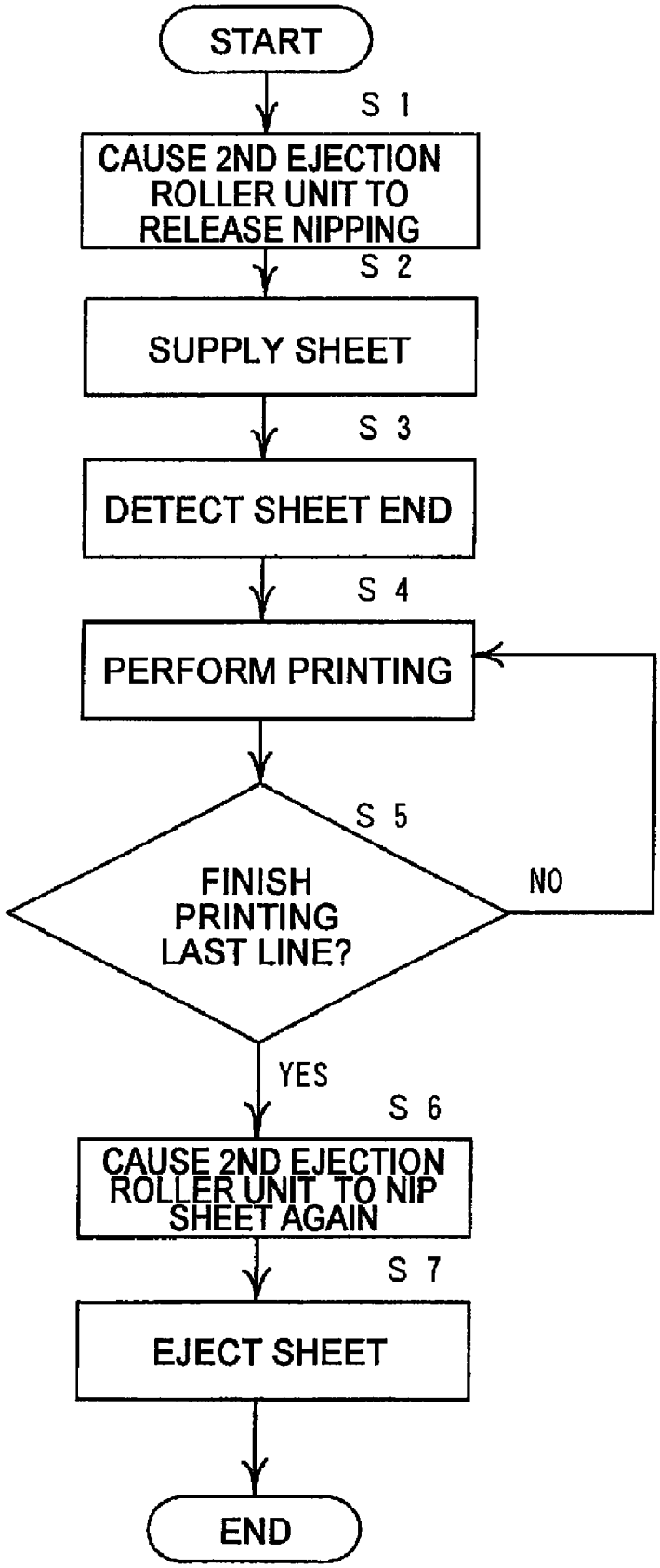
FIG. 7 is a flowchart illustrating a main routine of a moving operation of a second drive roller according to an embodiment of the invention.

FIG. 7 shows a flowchart which illustrates the steps carried out by job separator 14 to convey sheet P at the downstream side on output tray 19 in sheet conveyance direction A, according to an embodiment of the invention. In step S1, second drive roller 16*a* may be withdrawn from an origin where rack member 26 may be located at the most upstream position in sheet conveyance direction A, to a position shown in FIG. 1B, where second drive roller 16*a* may be released from a conveying position with second driven roller 16*b*. Subsequently, in step S2, sheet feed motor 45 may activate, and sheet supply tray 3 may supply sheet P. Then, at step S3, a leading end of sheet P may be detected by sheet detection sensor 47, which may be positioned in the vicinity of registration roller pair 13. In step S4, the leading end of sheet P may be conveyed, and may contact registration roller pair 13 for registration. Sheet P may be conveyed between registration rollers 13, and positioned between recording head 48 positioned on the lower surface of carriage 7, and platen 12, positioned on recording part 4. When sheet P is in this position, a known printing operation, e.g., an image recording operation may be performed.

In step S5, a determination may be made regarding whether printing of the last line of sheet P that has been fed to recording part 4 is finished. If printing of the last line is not finished, sheet P, now recorded, may be placed on second drive roller 16*a* without being conveyed between second drive roller 16*a* and second driven roller 16*b*. As sheet P is not conveyed, the upper surface or printed surface of sheet P is not brought into contact with second driven roller 16*b*. This may prevent ink from peeling off and transferring to another part, which may decrease print quality, particularly in a high quality image, such as a photo image.

If printing of the last line is finished, then in step S6, second drive roller 16*a* may be advanced to a conveying position with second driven roller 16*b*. In step S7, first conveyance roller unit 15 and second conveyance roller unit 16 then may be simultaneously driven. When sheet P is conveyed by second drive roller 16*a* and second driven roller 16*b* in second conveyance roller unit 16, it remains in contact with second drive roller 16*a* and second driven roller 16*b* up to a trailing end thereof, and then may be reliably conveyed to the downstream side on output tray 19, in sheet conveyance direction A.

In an embodiment of the invention, when the last line has been completely printed, sheet P may be conveyed to output tray 19 while being contacted by second conveyance roller unit 16 at the trailing end. Prior to being conveyed to output tray 19, during image recording by recording head 48, sheet P may be contacted by first conveyance roller unit 15, which may be positioned upstream of second conveyance roller unit 16, with respect to sheet conveyance direction A. Additionally, prior to being conveyed to output tray 19, during image recording by recording head 48, second conveyance roller unit 16 may be configured not to contact sheet P. Thus, a diameter of second drive roller 16*a* may be smaller than a diameter of first drive roller 15*a*.

As shown in FIGS. 1C and 2B, second drive roller 16*a* and guide plate 17 may be configured to be positioned higher than second driven roller 16*b*, and may be configured to be withdrawn to a recessed portion of an intermediate cover 28 of printer 1, when moving from first conveyance roller unit 15 toward the downstream side in sheet conveyance direction A. Thus, job separator 14 may be positioned without increasing the height of printer 1.

Each rack member 26 may be an actuator, which may be configured to move second drive roller 16*a* and guide plate 17 back and forth in sheet conveyance direction A. While each rack member 26 may be moved horizontally, second drive roller 16*a* and guide plate 17 may be guided vertically along guide groove 22. Thus, job separator 14 can be made compact without having to increase the height of job separator 14.

First drive roller 15*a* may compose a material which may have a high coefficient of friction, e.g., Ethylene Propylene Diene monomer (EPDM). Second drive roller 16*a* may compose a material having a low coefficient of friction, e.g., polyacetal resin (POM). The invention may be applied to multifunction devices ("MFD") which may have one or more of a printer function, copier function, scanner function, and facsimile function, as an example of the image recording device.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A job separator comprising:

a first roller unit comprising:

a first driven roller; and a first drive roller, wherein the first driven roller and the first drive roller are configured to receive a sheet therebetween;

a second roller unit positioned adjacent to and downstream of the first roller unit in a sheet conveyance direction, the second roller unit comprising:

a second driven roller; and a second drive roller configured to selectively move between a first position and a second position, wherein the second drive roller is further away from the first roller unit in the second position than in the first position, and wherein the second driven roller and the second drive roller are configured to receive a sheet therebetween when the second drive roller is in the first position, and the second driven roller and the second drive roller are configured not to receive a sheet therebetween when the second drive roller is in the second position, wherein the first roller unit and the second roller unit are configured to convey a sheet in a substantially lateral direction;

a guide plate extending between the first roller unit and the second drive roller, and configured to guide a sheet and to move along with the second drive roller; and a plurality of side frames, wherein the second drive roller further comprises a support shaft, the guide plate is attached to the support shaft, the second drive roller is positioned between the plurality of side frames, and each side frame comprises a groove configured to restrict a rotational position of the guide plate.

2. The job separator according to claim 1, further comprising:

an actuator configured to allow the second drive roller to move between the first position and the second position along the sheet conveyance direction; and a drive motor configured to alternately rotate clockwise and counterclockwise, and to operate the actuator.

3. The job separator according to claim 2, wherein each side frame comprises a guide portion configured to guide the actuator in a linear movement between the first position and the second position.

4. The job separator according to claim 2, wherein the actuator comprises a rack member configured to support the support shaft and to allow the second drive roller to move vertically.

5. The job separator according to claim 4, further comprising a gear transmission mechanism positioned between the drive motor and the rack member.

6. The job separator according to claim 1, wherein when the second drive roller is in the first position, the second drive roller and the second driven roller receive a sheet therebetween, and when the second drive roller is in the second position, the guide plate does not receive the sheet.

7. The job separator according to claim 6, wherein when the second drive roller moves between the first position and the second position, the second drive roller passes through an intermediate position in which the second drive roller and the guide plate receive a sheet therebetween, and wherein power is transmitted from the first drive roller to the second drive roller when the second drive roller is in the first position and in the intermediate position, and power is not transmitted from the first drive roller to the second drive roller when the second drive roller is in the second position.

8. The job separator according to claim 1, wherein the second drive roller is positioned below the second driven roller in the first position.

9. The job separator according to claim 1, wherein the second drive roller is positioned away from the second driven roller in the second position.

10. The job separator according to claim 1, wherein the second driven roller is maintained at the same position when the second drive roller is in the first position and when the second drive roller is in the second position.

11. The job separator according to claim 1, wherein the first drive roller is configured to transmit energy to the second drive roller, and the first drive roller and the second drive roller are configured to rotate in a predetermined direction when the first drive roller and the second drive roller are positioned within a predetermined distance from each other, and the first drive roller is configured to stop transmitting power when a distance between the first drive roller and the second drive roller is greater than the predetermined distance.

* * * * *